US011261887B2

(12) United States Patent
Rudrapatna Janardana et al.

(10) Patent No.: US 11,261,887 B2
(45) Date of Patent: Mar. 1, 2022

(54) MANIFOLD SYSTEM FOR FLUID DELIVERY

(71) Applicant: ASCO Numatics (India) Private Limited, Chennai (IN)

(72) Inventors: Lakshmikantha Rudrapatna Janardana, Chennai (IN); Senthil Ashokkumar, Chennai (IN); Soundharrajan Sachidanandam, Chennai (IN); Nilesh Puntambekar, Pune (IN)

(73) Assignee: ASCO Numatics (India) Private Limited, Chennai (IN)

( * ) Notice: Subject to any disclaimer, the term of this patent is extended or adjusted under 35 U.S.C. 154(b) by 0 days.

(21) Appl. No.: 17/033,617

(22) Filed: Sep. 25, 2020

(65) Prior Publication Data

US 2021/0095699 A1 Apr. 1, 2021

(51) Int. Cl.
*F15B 20/00* (2006.01)
*F15B 13/08* (2006.01)

(52) U.S. Cl.
CPC ..... *F15B 20/008* (2013.01); *F15B 13/0817* (2013.01); *F15B 13/0889* (2013.01); *F15B 2211/8757* (2013.01)

(58) Field of Classification Search
CPC ..... F15B 20/008; F15B 13/0817; F15B 13/0889; F15B 13/0896; F15B 2211/8757; F15B 2211/30565; F15B 2211/8636
See application file for complete search history.

(56) References Cited

U.S. PATENT DOCUMENTS 7,077,148 B2 * 7/2006 Schnell ..... F16K 37/0083 137/1
10,066,651 B2 * 9/2018 Sauer ..... F17C 13/04

FOREIGN PATENT DOCUMENTS

| | | | |
|---|---|---|---|
| DE | 33 31 897 | A1 | 3/1985 |
| DE | 10 2012 111127 | A1 | 5/2014 |
| DE | 10 2013 216790 | A1 | 2/2015 |
| WO | WO-2009/039349 | A1 | 3/2009 |
| WO | WO-2015/155786 | A1 | 10/2015 |

OTHER PUBLICATIONS

International Search Report and Written Opinion for PCT/IB2020/00782, dated Feb. 28, 2021.

* cited by examiner

*Primary Examiner* — F Daniel Lopez
(74) *Attorney, Agent, or Firm* — Marshall, Gerstein & Borun LLP

(57) ABSTRACT

The present disclosure relates to the field of fluid process systems and discloses a manifold system for fluid delivery. The system comprises a first set of Solenoid Operated Valves (SOVs), a second set of SOVs, a plurality of isolating valves, at least one first shuttle valve, and at least one redundant shuttle valve. Each set of SOVs includes at least two SOVs arranged in parallel. The SOVs together form a series-parallel redundancy. Each isolating valve is coupled to an SOV and facilitates hot swapping of that SOV. The redundant shuttle valves provide redundancy to the first shuttle valve and facilitate the flow of a fluid from each of the first set of SOVs to each of the second set of SOVs, thereby promoting system safety and availability.

10 Claims, 7 Drawing Sheets

| SI.NO | V1 | V2 | V4 | V6 | CYL |
|---|---|---|---|---|---|
| 1 | 1 | 0 | 0 | 0 | 0 |
| 2 | 1 | 1 | 0 | 0 | 0 |
| 3 | 1 | 1 | 1 | 0 | 1 |
| 4 | 1 | 1 | 1 | 1 | 1 |
| 5 | 0 | 1 | 0 | 0 | 0 |
| 6 | 0 | 1 | 1 | 0 | 1 |
| 7 | 0 | 1 | 1 | 1 | 1 |
| 8 | 0 | 1 | 0 | 1 | 1 |
| 9 | 0 | 0 | 1 | 0 | 0 |
| 10 | 0 | 0 | 1 | 1 | 0 |
| 11 | 1 | 0 | 1 | 1 | 1 |
| 12 | 1 | 0 | 1 | 0 | 1 |
| 13 | 0 | 0 | 0 | 1 | 0 |
| 14 | 1 | 0 | 0 | 1 | 1 |
| 15 | 1 | 1 | 0 | 1 | 1 |
| 16 | 0 | 0 | 0 | 0 | 0 |

Table 1

FIG. 6

TRUTH TABLE

| SL.NO | V1 | V2 | V3 | V4 | V5 | V6 | CYL |
|---|---|---|---|---|---|---|---|
| 1 | 0 | 0 | 0 | 0 | 0 | 1 | 0 |
| 2 | 0 | 0 | 0 | 0 | 1 | 0 | 0 |
| 3 | 0 | 0 | 0 | 0 | 1 | 1 | 0 |
| 4 | 0 | 0 | 0 | 1 | 0 | 0 | 0 |
| 5 | 0 | 0 | 0 | 1 | 0 | 1 | 0 |
| 6 | 0 | 0 | 0 | 1 | 1 | 0 | 0 |
| 7 | 0 | 0 | 0 | 1 | 1 | 1 | 0 |
| 8 | 0 | 0 | 1 | 0 | 0 | 0 | 0 |
| 9 | 0 | 0 | 1 | 0 | 0 | 1 | 1 |
| 10 | 0 | 0 | 1 | 0 | 1 | 0 | 1 |
| 11 | 0 | 0 | 1 | 0 | 1 | 1 | 1 |
| 12 | 0 | 0 | 1 | 1 | 0 | 0 | 1 |
| 13 | 0 | 0 | 1 | 1 | 0 | 1 | 1 |
| 14 | 0 | 0 | 1 | 1 | 1 | 0 | 1 |
| 15 | 0 | 0 | 1 | 1 | 1 | 1 | 1 |
| 16 | 0 | 1 | 0 | 0 | 0 | 0 | 0 |
| 17 | 0 | 1 | 0 | 0 | 0 | 1 | 1 |
| 18 | 0 | 1 | 0 | 0 | 1 | 0 | 1 |
| 19 | 0 | 1 | 0 | 0 | 1 | 1 | 1 |
| 20 | 0 | 1 | 0 | 1 | 0 | 0 | 1 |
| 21 | 0 | 1 | 0 | 1 | 0 | 1 | 1 |
| 22 | 0 | 1 | 0 | 1 | 1 | 0 | 1 |
| 23 | 0 | 1 | 0 | 1 | 1 | 1 | 1 |
| 24 | 0 | 1 | 1 | 0 | 0 | 0 | 0 |
| 25 | 0 | 1 | 1 | 0 | 0 | 1 | 1 |
| 26 | 0 | 1 | 1 | 0 | 1 | 0 | 1 |
| 27 | 0 | 1 | 1 | 0 | 1 | 1 | 1 |
| 28 | 0 | 1 | 1 | 1 | 0 | 0 | 1 |
| 29 | 0 | 1 | 1 | 1 | 0 | 1 | 1 |
| 30 | 0 | 1 | 1 | 1 | 1 | 0 | 1 |
| 31 | 0 | 1 | 1 | 1 | 1 | 1 | 1 |
| 32 | 1 | 0 | 0 | 0 | 0 | 0 | 0 |
| 33 | 1 | 0 | 0 | 0 | 0 | 1 | 1 |
| 34 | 1 | 0 | 0 | 0 | 1 | 0 | 1 |
| 35 | 1 | 0 | 0 | 0 | 1 | 1 | 1 |
| 36 | 1 | 0 | 0 | 1 | 0 | 0 | 1 |
| 37 | 1 | 0 | 0 | 1 | 0 | 1 | 1 |
| 38 | 1 | 0 | 0 | 1 | 1 | 0 | 1 |
| 39 | 1 | 0 | 0 | 1 | 1 | 1 | 1 |
| 40 | 1 | 0 | 1 | 0 | 0 | 0 | 0 |
| 41 | 1 | 0 | 1 | 0 | 0 | 1 | 1 |
| 42 | 1 | 0 | 1 | 0 | 1 | 0 | 1 |
| 43 | 1 | 0 | 1 | 0 | 1 | 1 | 1 |
| 44 | 1 | 0 | 1 | 1 | 0 | 0 | 1 |
| 45 | 1 | 0 | 1 | 1 | 0 | 1 | 1 |
| 46 | 1 | 0 | 1 | 1 | 1 | 0 | 1 |
| 47 | 1 | 0 | 1 | 1 | 1 | 1 | 1 |
| 48 | 1 | 1 | 0 | 0 | 0 | 0 | 0 |
| 49 | 1 | 1 | 0 | 0 | 0 | 1 | 1 |
| 50 | 1 | 1 | 0 | 0 | 1 | 0 | 1 |
| 51 | 1 | 1 | 0 | 0 | 1 | 1 | 1 |
| 52 | 1 | 1 | 0 | 1 | 0 | 0 | 1 |
| 53 | 1 | 1 | 0 | 1 | 0 | 1 | 1 |
| 54 | 1 | 1 | 0 | 1 | 1 | 0 | 1 |
| 55 | 1 | 1 | 0 | 1 | 1 | 1 | 1 |
| 56 | 1 | 1 | 1 | 0 | 0 | 0 | 0 |
| 57 | 1 | 1 | 1 | 0 | 0 | 1 | 1 |
| 58 | 1 | 1 | 1 | 0 | 1 | 0 | 1 |
| 59 | 1 | 1 | 1 | 0 | 1 | 1 | 1 |
| 60 | 1 | 1 | 1 | 1 | 0 | 0 | 1 |
| 61 | 1 | 1 | 1 | 1 | 0 | 1 | 1 |
| 62 | 1 | 1 | 1 | 1 | 1 | 0 | 1 |
| 63 | 1 | 1 | 1 | 1 | 1 | 1 | 1 |
| 64 | 0 | 0 | 0 | 0 | 0 | 0 | 0 |

Table 2

FIG. 7

MANIFOLD SYSTEM FOR FLUID DELIVERY

TECHNICAL FIELD

The present disclosure generally relates to a manifold system for continuous process delivery. More particularly, the present disclosure relates to a safety and availability manifold system for various applications, including but not limited to petroleum downstream complexes and/or petrochemical industries.

Glossary of Terms

As used in the present disclosure, the following terms are generally employed in the industry and may be useful in assisting the reader in understanding one or more aspects of the following disclosure:

Manifold—The term "Manifold" generally refers to an equipment designed to converge multiple junctions into a single channel or diverge a single channel into multiple junctions for facilitating distribution of fluids.

Hot swapping—The term "hot swapping" generally refers to a process of adding and replacing components of a system without having to shut down the power to the system.

Shuttle Valve—The term "shuttle valve" generally refers to a three-way valve, which is often implemented as a three-way valve having a floating ball at the center. Such valves typically have two input ports and one output port. With an input from one input port, the ball shifts and blocks the other input port, thus allowing a fluid connection between the one input port and the output port. With inputs from both the input ports, the ball moves to center, thus allowing the flow from the two input ports to exit from the output port.

BACKGROUND

The background information herein below relates to the present disclosure but is not necessarily prior art.

Currently, petrochemical, chemical, refining and petroleum industries all desire and work toward improving both the safety and availability of systems involved in carrying out various industrial processes. One consideration can be the ease by which the system can be fully or partially turned off in the face of a malfunction or imminent danger. In contrast, availability is defined as the degree to which a system stays operable under different operating conditions and avoiding spurious system trips. In processing and manufacturing industries, valves play a role in controlling different operations. System designers strive to arrange these valves so as to foster safety and availability of the industrial systems in which they are employed. For example, one approach to foster safety is to arrange the valves in series. In such an arrangement, if a single valve fails, the entire line is automatically deactivated. To enforce availability, the valves are arranged in parallel. In that case, when a single valve fails, the system continues to operate due to the functioning of parallel valves.

Typically, a fluid delivery system in a process plant includes many valves, and these valves generally are categorized as manual and automatic. One of the types of automatic valves is a 3/2 poppet valve also referred to as 3/2 solenoid valve. The 3/2 poppet valve represents a 3-port, 2-position poppet valve. The differentiating factor of the 3/2 valve from a regular 2/2 valve is the presence of an extra port for diversion of a process fluid. In one position, a fluid flows from an inlet port of the poppet valve to an application port and in other position, the fluid flows from the inlet port to an outlet port connected to an exhaust port. In a process plant, such poppet valves may experience failure under certain conditions. When a valve fails, isolation of the valve from the system is required to carry out maintenance and replacement. This affects the reliability and availability of the system.

Thus, one problem that can be associated with conventional systems is the repair and restoration process under which there is a requirement to shut the entire process in order to repair and restore valves. In a continuous process industry, this means a huge production loss for the whole time the valves are being restored.

Conventional systems, as the one shown and described patent publication WO2015/155786 A1, do not provide shuttle valve redundancy. Further, there is no means to bypass an entire fluid delivery system, or provide redundancy to an entire fluid delivery system, when there are multiple failed valves and replacement of all the failed valves is required.

Therefore, there is felt a need for a manifold system that facilitates flow of fluid from all the valves located near the fluid inlet to all the valves located near the fluid outlet, thereby improving the system availability.

SUMMARY

In accordance with a first exemplary aspect, a manifold system assembled system comprises a plurality of manifold assemblies, with each of the manifold assemblies comprising a first set of solenoid operated valves (SOVs), a second set of SOVs, a plurality of first isolating valves, at least one first shuttle valve, and at least one redundant shuttle valve. The first set of SOVs are positioned near a fluid inlet and comprise at least two SOVs arranged in parallel. The second set of SOVs are connected in series with the first set of SOVs. The second set of SOVs are positioned near a fluid outlet and comprise at least two SOVs arranged in parallel. Each of the first isolating valves are coupled to each of the SOVs. Each first isolating valve is adapted to facilitate hot swapping of the associated SOV. The first shuttle valve is connected between the first set of SOVs and the second set of SOVs. The redundant shuttle valve is configured to provide redundancy to the first shuttle valve in a way that the flow of a fluid is facilitated from each of the first set of SOVs to each of the second set of SOVs, thereby improving the system availability. The fluid comprises at least one of air, neutral gas, liquid, and natural gas.

In accordance with a second exemplary aspect, a manifold system for fluid delivery comprises a manifold assembly, with the manifold assembly including a plurality of first Solenoid Operated Valves positioned toward a fluid inlet and arranged in parallel, a plurality of second Solenoid Operated Valves connected in series with the first Solenoid Operated Valves, with the second Solenoid Operated Valves positioned toward a fluid outlet and arranged in parallel. A plurality of first isolating valves is provided, with each of the first isolating valves arranged to be operatively connectable to each of the first and second Solenoid Operated Valves. At least one first shuttle valve is connected between the first Solenoid Operated Valves and the second Solenoid Operated Valves, and at least one redundant shuttle valve is configured to provide redundancy to the at least one first shuttle valve to allow the flow of a fluid from each of the first Solenoid Operated Valves to each of the second Solenoid Operated Valves.

In further accordance with any one or more of the foregoing first or second aspects, a manifold system for fluid delivery may further include any one or more of the following preferred forms.

In some preferred forms, the manifold system includes a bypass valve for providing an alternative fluid bypass path from the fluid inlet to the fluid outlet.

In some preferred forms, a plurality of the manifold assemblies are provided and are connected in parallel.

In some preferred forms, each of the manifold assemblies is connected to the fluid outlet via a common outlet shuttle valve.

In some preferred forms, each of the manifold assemblies is connected to the fluid inlet via a second isolating valve.

In some preferred forms, each of the manifold assemblies is connected to the fluid inlet via a second isolating valve, and wherein the second isolating valves are Manually Operated Valves.

In some preferred forms, the first isolating valves are Manually Operated Valves.

In some preferred forms, a plurality of indicators is provided, and wherein each of the indicators is connected to each of the solenoid operated valves to indicate the status of the solenoid operated valves.

In some preferred forms, a plurality of pressure sensors is provided, wherein each of the pressure sensors is connected to each of the solenoid operated valves to indicate a status of the valves.

In some preferred forms, the system includes at least one second shuttle valve connecting the second solenoid operated valves to the fluid outlet.

In some preferred forms, each of the manifold assemblies includes a plurality of third shuttle valves, each of said third shuttle valves operatively coupled to a selected one of first shuttle valves and to an input port of one redundant shuttle valve to allow the flow of the fluid from each of the first solenoid operated valves to each of the second solenoid operated valves.

In some preferred forms, each of the first solenoid operated valves is a 3/2 poppet valve.

In some preferred forms, each of the isolating valves is a 3/2 valve.

In some preferred forms, at least one exhaust is provided to vent exhaust residue.

In some preferred forms, said fluid comprises at least one of air, neutral gas, liquid, or natural gas.

Advantageously, the system promotes hot swapping of an associated Solenoid Operated Valve and promotes system availability.

Advantageously, the system includes a bypass valve for providing an alternative bypass path to the fluid from the fluid inlet to the fluid outlet to facilitate maintenance of the manifold assembly.

Advantageously, the manifold assemblies are connected in parallel to improve the system reliability. Each of the manifold assemblies is connected to the fluid inlet via a second isolating valve and to the fluid outlet via a common outlet shuttle valve.

BRIEF DESCRIPTION OF THE DRAWINGS

A manifold system for fluid delivery of the present disclosure will now be described with the help of the accompanying drawing, in which:

FIG. 6 illustrates a first truth table (Table 1) depicting output of the system of FIGS. 3 and 4.

FIG. 7 illustrates a second truth table (Table 2) depicting output of the system for various operating states of the SOVs.

LIST OF REFERENCE NUMERALS

300—System
10—Manifold Assembly
102—Fluid inlet
104—Fluid outlet
106—Actuator
108—Exhaust
V1-V6—Solenoid operated valves (SOVs)
I1-I6—First isolating valves
M1, M2—Second isolating valves
B1—Bypass valve
S1, S4-S6—First shuttle valves
S3, S4'-S6'—Redundant shuttle valves
S2, S7-S9—Second shuttle valves
S1'-S3'—Third shuttle valves
S10—Common outlet shuttle valve
S11—Shuttle valve for bypass valve
A, B, C, D, E, F, G—Indicators
P1, P2, P3, P4, P5, P6, PB1—Pressure sensors

DETAILED DESCRIPTION

Embodiments, of the present disclosure, will now be described with reference to the accompanying drawing.

Embodiments are provided so as to thoroughly and fully convey the scope of the present disclosure to the person skilled in the art. Numerous details, are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a," "an," and "the" may be intended to include the plural forms as well, unless the context clearly suggests otherwise. The terms "comprises," "comprising," "including," and "having," are open ended transitional phrases and therefore specify the presence of stated features, integers, operations, elements, modules, units and/or components, but do not forbid the presence or addition of one or more other features, integers, operations, elements, components, and/or groups thereof.

When an element is referred to as being "mounted on," "engaged to," "connected to," or "coupled to" another element, it may be directly on, engaged, connected or coupled to the other element. As used herein, the term "and/or" includes any and all combinations of one or more of the associated listed elements.

The terms first, second, third, etc., should not be construed to limit the scope of the present disclosure as the aforementioned terms may be only used to distinguish one element, component, or section from another element, component, or section. Terms such as first, second, third etc., when used herein do not imply a specific sequence or order unless clearly suggested by the present disclosure.

A manifold system for fluid delivery (hereinafter referred as "system (300)"), of the present disclosure, is now being described with reference to FIG. 2 through FIG. 5. The system (300) is designed to improve safety and reliability of the industrial process in which it is employed.

Figure 3:
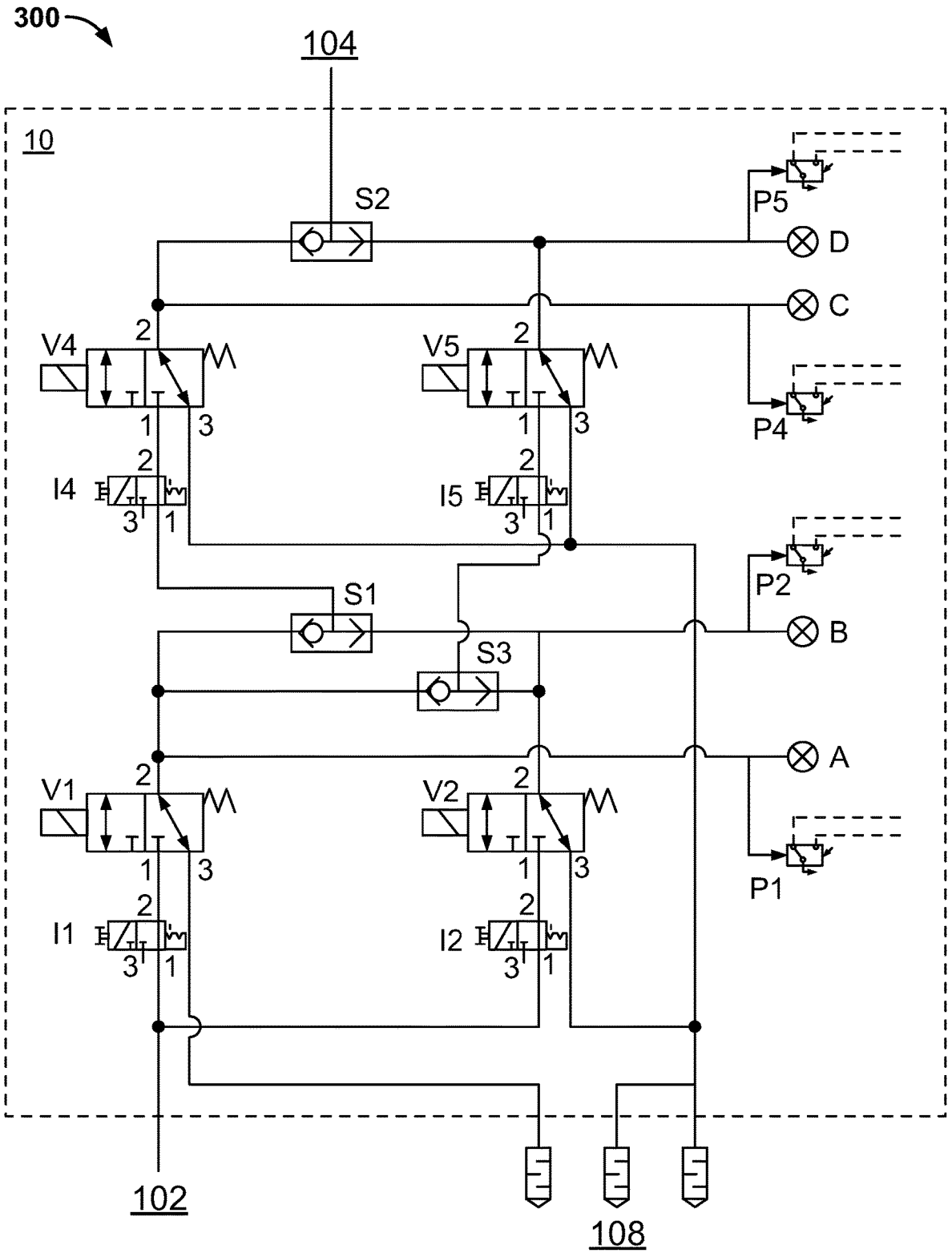
FIG. 3 illustrates a circuit diagram of a manifold system assembled in accordance with the teachings of an embodiment of the present disclosure and having a single manifold assembly including four solenoid operated valves.
Figure 4:
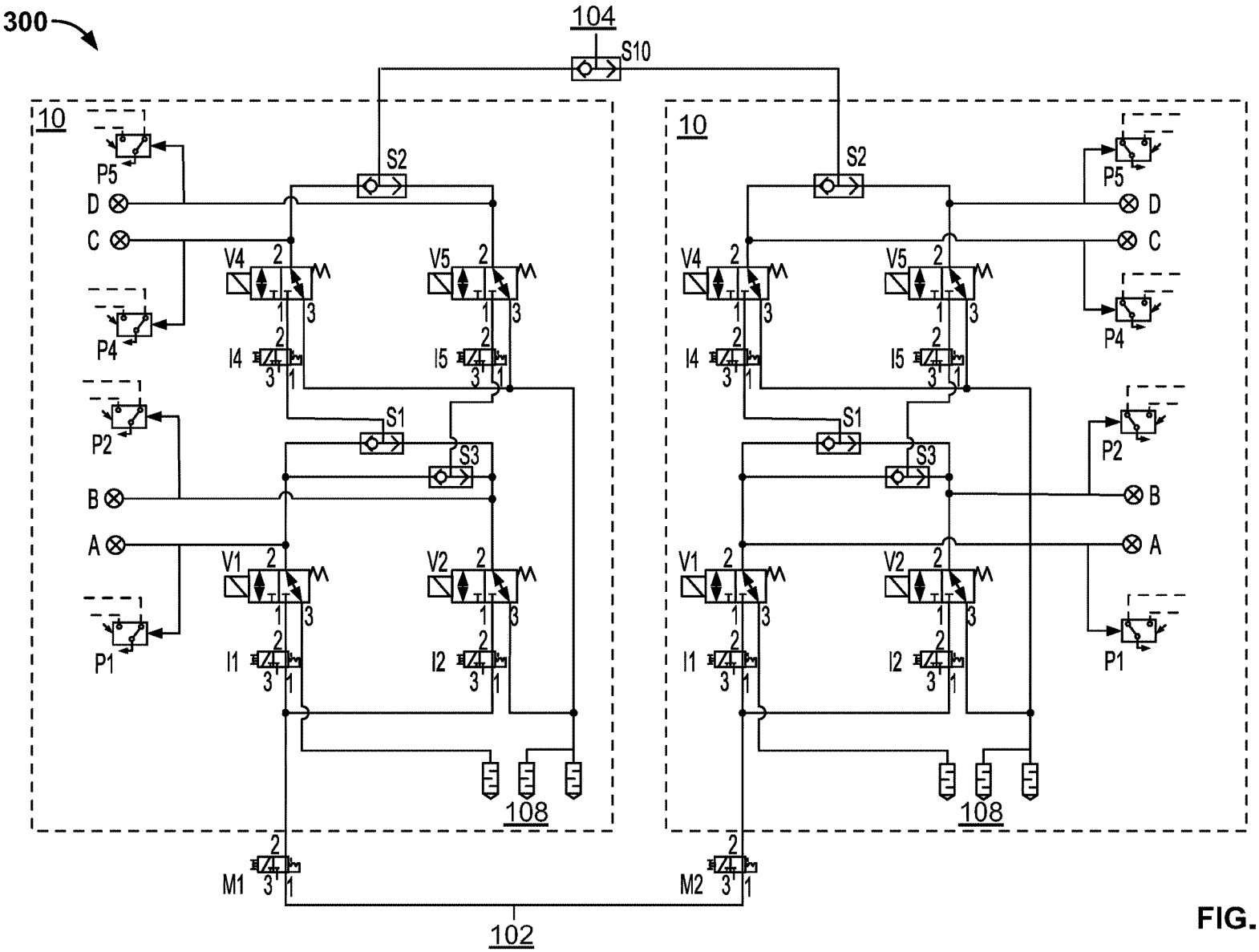
FIG. 4 illustrates a circuit diagram of the manifold system similar to FIG. 3 and having two manifold assemblies.
Figure 5:
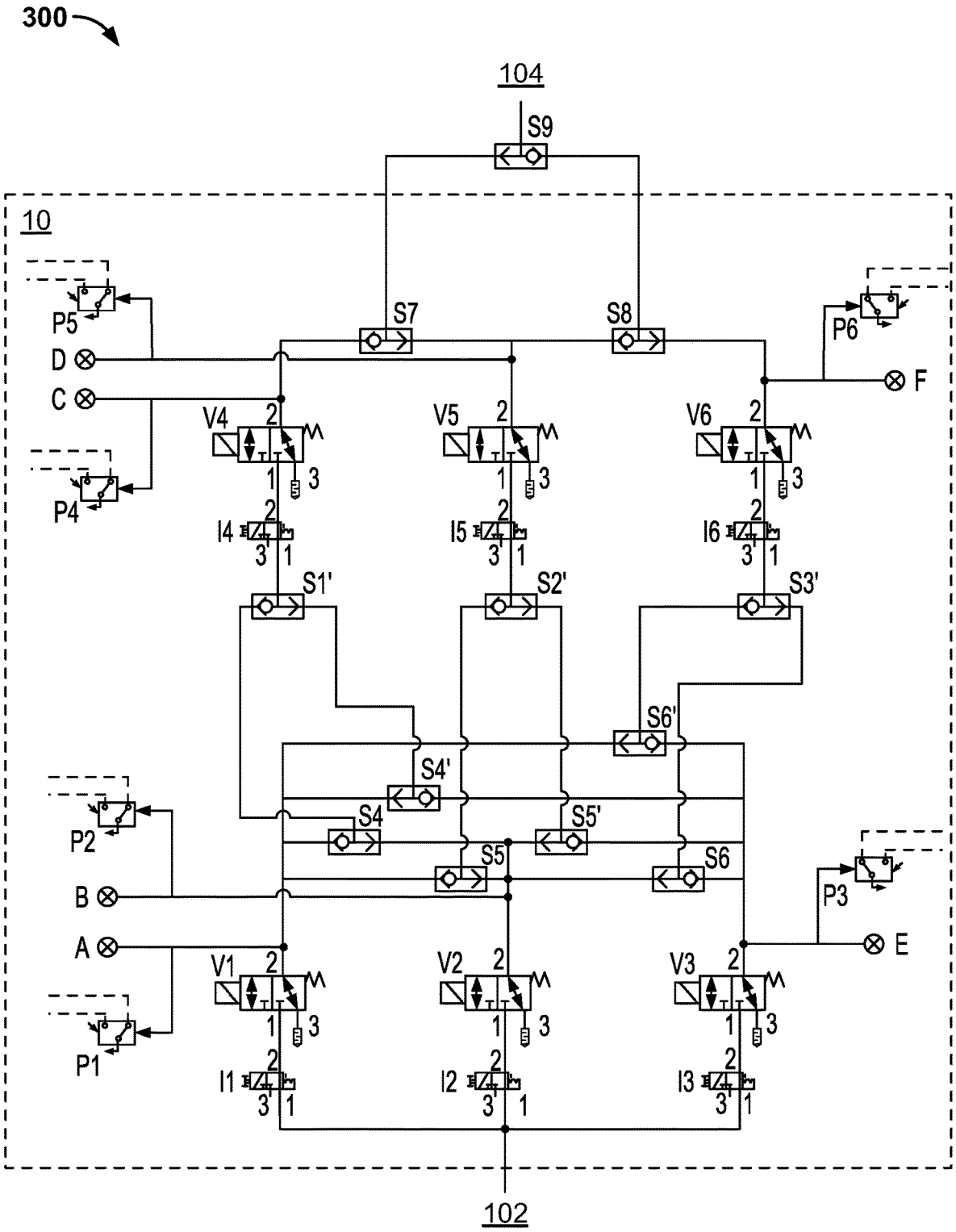
FIG. 5 illustrates a circuit diagram of a manifold system similar to FIGS. 3 and 4 but having a manifold assembly with six solenoid operated valves.

Referring to FIGS. 3, 4 and 5, the manifold system (300) of present disclosure comprises a plurality of manifold assemblies (10). Each of the manifold assemblies (10) include a first set of SOVs [(V1-V2), (V1-V3)], a second set of SOVs [(V4-V5), (V4-V6)], a plurality of first isolating valves [(I1-I2, I4-I5), (I1-I6)], at least one first shuttle valve [(S1), (S4-S6)], and at least one redundant shuttle valve [(S3), (S4'-S6')]. The first set of SOVs [(V1-V2), (V1-V3)] are positioned near a fluid inlet (102) and comprise at least two SOVs [(V1-V2), (V1-V3)] arranged in parallel. The second set of SOVs [(V4-V5), (V4-V6)] are connected in series with the first set of SOVs [(V1-V2), (V1-V3)]. The second set of SOVs [(V4-V5), (V4-V6)] are positioned near a fluid outlet (104) and comprise at least two SOVs [(V4-V5), (V4-V6)] arranged in parallel. Each of the first isolating valves [(I1-I2, I4-I5), (I1-I6)] are coupled to each of the SOVs [(V1-V2, V4-V5), (V1-V6)]. Each first isolating valve [(I1-I2, I4-I5), (I1-I6)] is adapted to facilitate hot swapping of associated SOV [(V1-V2, V4-V5), (V1-V6)].

The configuration of the circuit of the manifold system (300) is such that the redundancies provided by the SOVs [(V1-V2, V4-V5), (V1-V6)] are subject to hot swapping with the help of the first isolating valves [(I1-I2, I4-I5), (I1-I6)]. For example, with reference to FIG. 3, when the SOV (V1) is in de-energized state and the rest of the SOVs (V2, V4, V5) are in energized state, the fluid at the intake for SOV (V1) finds no escape. In such a state, the corresponding first isolating valve (I1) is activated to perform hot swapping. This isolates the fluid supply to the SOV (V1), which now can be taken out for maintenance. This ensures no stoppage of the process and the system (300) continues to work with the other working valves (V2, V4, V5).

As shown in FIGS. 3-5, the first shuttle valve [(S1), (S4-S6)] is connected between the first set of SOVs [(V1-V2), (V1-V3)] and the second set of SOVs [(V4-V5), (V4-V6)]. The redundant shuttle valve [(S3), (S4'-S6')] is configured to provide redundancy to the first shuttle valve [(S1), (S4-S6)] in a way that the flow of a fluid is facilitated from each of the first set of SOVs [(V1-V2), (V1-V3)] to each of the second set of SOVs [(V4-V5), (V4-V6)], thereby improving the system availability. The fluid to be transferred from the fluid inlet (102) to the fluid outlet (104) comprises at least one of air, neutral gas, liquid, and natural gas.

In an embodiment, the system (100) further includes at least one second shuttle valve [(S2), (S7-S9)] connecting the second set of SOVs [(V4-V5), (V4-V6)] to the fluid outlet (104). The second shuttle valves [(S2), (S7-S9)] may be further connected to an actuator (106), which gets actuated on receipt of the fluid. According to an embodiment, the actuator (106) is a rack and pinion arrangement with springs attached at opposite ends.

Thus, in the system (100) of FIG. 3, the first set of SOVs i.e. the SOVs (V1, V2) located near the fluid inlet (102) are connected to the shuttle valves (S1, S3). The first shuttle valve (S1) is connected to the SOV (V4) and the redundant shuttle valve (S3) is connected to the SOV (V5) through the first isolating valves (I4) and (I5) respectively. The second set of SOVs (V4, V5) are connected to the fluid outlet (104) through the second shuttle valve (S2).

As shown in FIG. 6, the truth table (Table 1) depicts output of the system (300) of FIGS. 3 and 4 under different operating states of the SOVs (V1, V2, V4, V5). The states include ON state/energized state (depicted by logic 0) and OFF state/de-energized state (depicted by logic 1).

It can be seen from Table 1 of FIG. 6 at row 14 that introduction of an additional redundant shuttle valve (S3) in the system (300) causes the fluid to be available at the outlet (104) even when the SOVs (V2 and V4) are in a de-energized/OFF state, thereby improving the system reliability and availability.

Advantageously, the plurality of manifold assemblies (10) are connected in parallel as shown in FIG. 4. This leads to a further improvement in the system reliability and availability. Each of the manifold assemblies (10) is connected to the fluid inlet (102) via a second isolating valve (M1, M2). Each of the manifold assemblies (10) is connected to the fluid outlet (104) via a common outlet shuttle valve (S10). This arrangement makes it easier to replace one or more faulty SOVs (V1, V2, V4, V5) or faulty shuttle valves (S1, S2, S3) online i.e. when the system (300) is operating. Even four SOVs (V1, V2, V4, V5) of the embodiment of FIG. 3 can be simultaneously removed and replaced without affecting the flow of fluid through the outlet (104). The probability of failure or total shutdown of the system (300) is also minimized.

In an embodiment, the first isolating valve [(I1-I2, I4-I5) (I1-I6)] and the second isolating valve (M1, M2) are Manually Operated Valves (MOVs).

Figure 1:
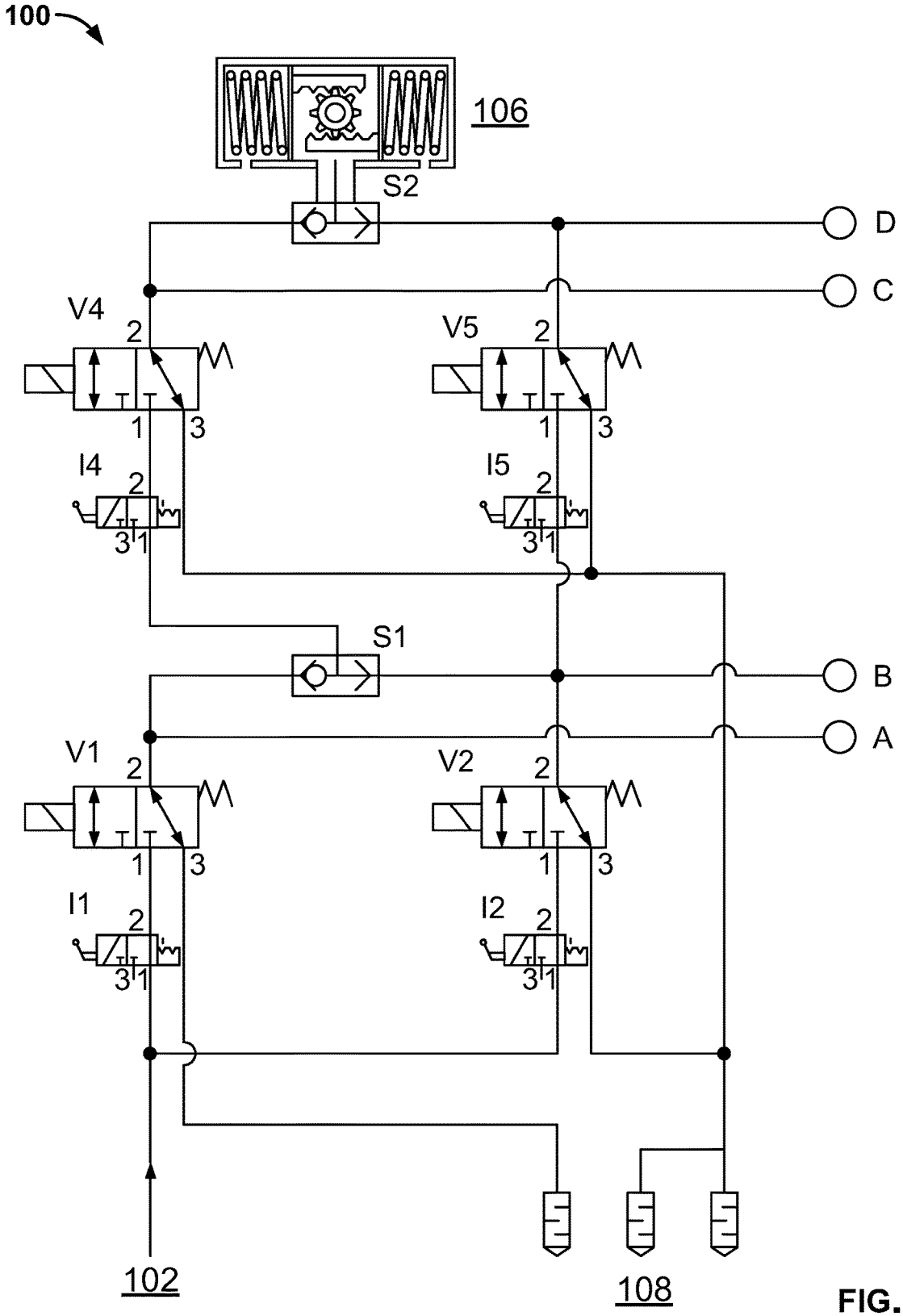
FIG. 1 (Prior Art)
FIG. 1 illustrates a circuit diagram of a typical manifold system.
Figure 2:
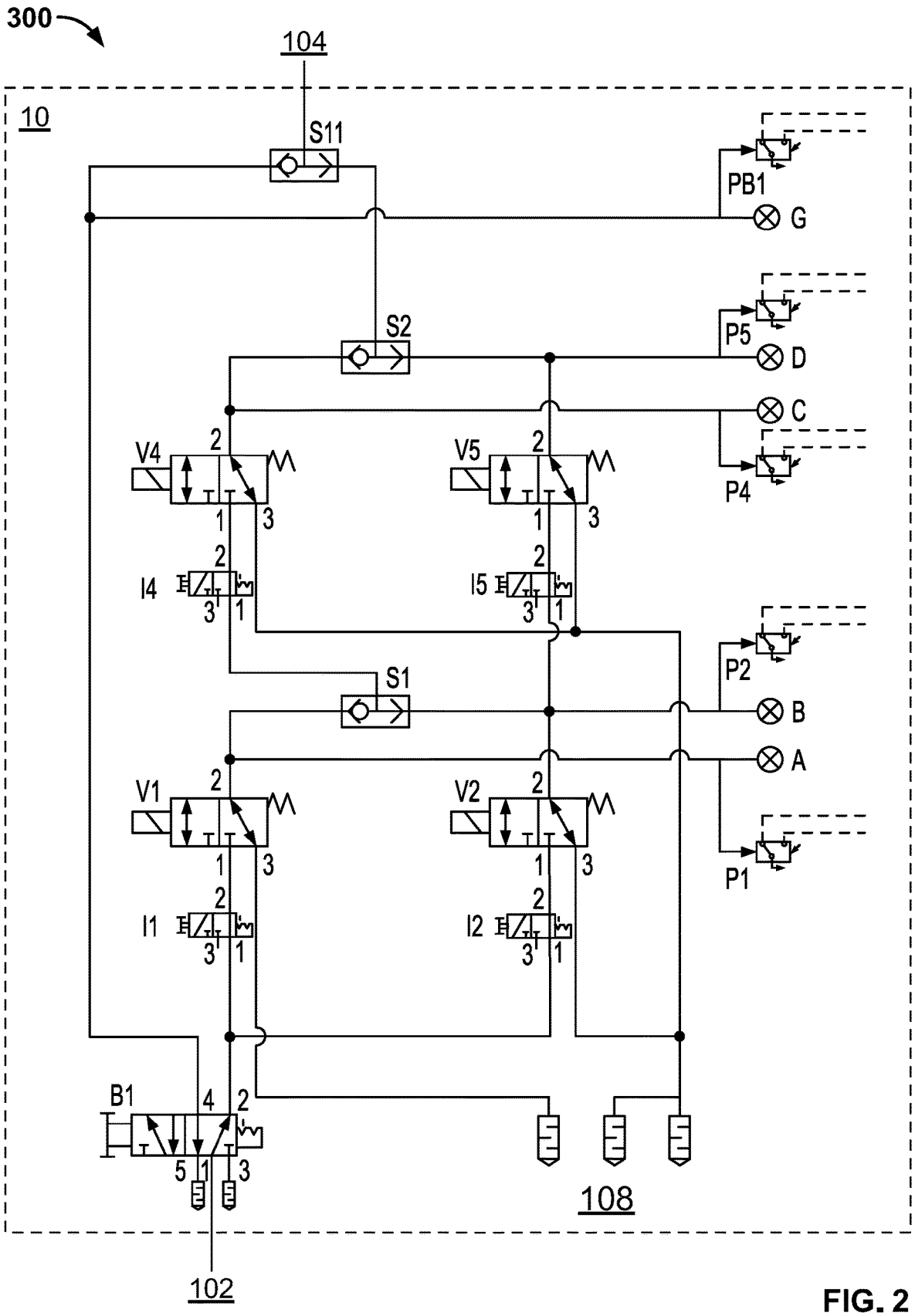
FIG. 2 illustrates a circuit diagram of the manifold system of FIG. 1 with a bypass valve.

As shown in FIGS. 1 and 2, in an embodiment, the system (300) includes a plurality of indicators [(A, B, C, D), (A, B, C, D, E, F)] wherein each of the indicators [(A, B, C, D), (A, B, C, D, E, F)] is connected to each of the SOVs [(V1-V2, V4-V5), (V1-V6)] to indicate the status of the SOVs [(V1-V2, V4-V5), (V1-V6)]. In another embodiment, the system (300) includes a plurality of pressure sensors [(P1, P2, P3, P4), (P1, P2, P3, P4, P5, P6)] wherein each of the pressure sensors [(P1, P2, P3, P4), (P1, P2, P3, P4, P5, P6)] is connected to each of the SOVs [(V1-V2, V4-V5), (V1-V6)] to indicate the status of the SOVs [(V1-V2, V4-V5), (V1-V6)]. In still another embodiment, the system (300) includes both the indicators [(A, B, C, D) (A, B, C, D, E, F)] and the pressure sensors [(P1, P2, P3, P4), (P1, P2, P3, P4, P5, P6)].

Referring to an embodiment of FIG. 2, the system (300) includes a bypass valve (B1) for providing an alternative bypass path to the fluid from the fluid inlet (102) to the fluid outlet (104). This facilitates easy replacement of single or multiple SOVs [(V1-V2, V4-V5), (V1-V6)] and shuttle valves (S1-S9, S1'-S6'). The bypass valve (B1) may be connected to the fluid outlet (104) via another shuttle valve (S11). The system (300) may also include an indicator (G) and/or a pressure sensor (PB1) associated with the bypass valve (B1) for indicating its status.

FIG. 5 depicts an embodiment of the manifold system (300) with six SOVs (V1-V6). In this embodiment, the manifold assembly (10) includes a plurality of third shuttle valves (S1'-S3'). Each of the third shuttle valves (S1'-S3') is operatively coupled to one first shuttle valve (S4-S6) and one redundant shuttle valve (S4'-S6') at its input ports to facilitate the flow of the fluid from each of the first set of SOVs (V1-V3) to each of the second set of SOVs (V4-V6), for improving shuttle valve redundancy and system availability. Thus, the system (300) includes six SOVs (V1-V6) and six first isolating valves (I1-I6) connected to the fluid outlet (104) through the twelve shuttle valves (S4-S9, S1'-S6'). The outlet of the SOV (V1) is connected to the input ports of the shuttle valves (S4, S4', S5, S6'). The outlet of the SOV (V2) is connected to the input ports of the shuttle valves (S4, S5, S5', S6). The outlet of the SOV (V3) is connected to the input ports of the shuttle valves (S4', S5', S6, S6'). The output ports of the shuttle valves (S4, S4') are connected to the input ports of the shuttle valve (S1'). The output ports of the shuttle valves (S5, S5') are connected to the input ports of the shuttle valve (S2'). The output ports of the shuttle valves (S6, S6') are connected to the input ports of the shuttle valve (S3'). The output port of the shuttle valve (S1') is connected to the inlet of the SOV (V4) through the first isolating valve (I4). The output port of the shuttle valve (S2') is connected to the inlet of the SOV (V5) through the first isolating valve (I5). The output port of the shuttle valve (S3') is connected to the inlet of the SOV (V6) through the first isolating valve (I6). The outlet of the SOV (V4) is connected to the input port of the shuttle valve (S7). The outlet of the SOV (V5) is connected to the input port of the shuttle valve (S7, S8). The outlet of the SOV (V6) is connected to the input port of the shuttle valve (S8). The output ports of the shuttle valves (S7, S8) are connected to the input ports of the shuttle valve (S9), which is connected to the fluid outlet (104).

As shown in FIG. 7, the truth table (Table 2) shows output of the system (500) for various operating states of the SOVs (V1-V6).

It can be seen from the truth table of FIG. 7 that the fluid is received at the fluid outlet (104) even when only the SOVs (V1 and V6) or SOVs (V3 and V4) are in energized state and rest of the SOVs (V2-V5) or (V1, V2, V5, V6) are in de-energized state.

The system (300) as shown in FIG. 5 provides shuttle valve redundancy and facilitates individual isolation of both the SOVs (V1-V6) and the shuttle valves (S1-S8). Further, the inclusion of additional shuttle values (S1'-S6') improves the availability of the system and also minimizes probability of failure/complete shutdown of the system.

In an embodiment, the SOVs [(V1-V2, V4-V5), (V1-V6)] are 3/2 poppet valves and the isolating valves [(I1-I2, I4-I5), (I1-I6)] are 3/2 valves.

In an embodiment, the system (300) includes at least one exhaust (108) to vent out the exhaust residue into the atmosphere.

Advantageously, the SOVs [(V1-V2, V4-V5), (V1-V6)] and the first isolating valves [(I1-I2, I4-I5), (I1-I6)] are merged together to eliminate the need of two different mounting arrangements.

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

When assembled in accordance with the teachings of one or more aspects of the present disclosure, a manifold system for fluid delivery may promote or maintain system availability at all the times, may facilitate easier maintenance and/or repair of solenoid operated valves, may increase system reliability, and may facilitate individual isolation and/or servicing of solenoid operated valves.

When assembled in accordance with the teachings herein, a manifold system for fluid delivery may facilitate easier maintenance of multiple faulty valves without having to shut down the entire process, may facilitate replacement of multiple faulty valves without unduly disturbing the outlet flow, may facilitate easier replacement of shuttle valves, and may lessen the probability of a total shutdown.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

The invention claimed is:

1. A manifold system for fluid delivery, the manifold system comprising:

a manifold assembly, the manifold assembly comprising:

a plurality of first Solenoid Operated Valves positioned toward a fluid inlet;

a plurality of second Solenoid Operated Valves located downstream of and in series relative to the plurality of first Solenoid Operated Valves and positioned toward a fluid outlet;

each of the plurality of first Solenoid Operated Valves being selectively connectable to a selected one of the plurality of second Solenoid Operated Valves via a first shuttle valve or a redundant shuttle valve;

a first isolating valve positioned upstream of the plurality of first Solenoid Operated Valves, the first isolating valve arranged to be selectively connectable to each of the plurality of first Solenoid Operated Valves; and wherein the redundant shuttle valve is arranged to provide redundancy to the first shuttle valve to allow a flow of a fluid from a selected one of the plurality of first Solenoid Operated Valves to a selected one of the plurality of second Solenoid Operated Valves;

thereby permitting hot swapping of a failed one of the Solenoid Operated Valves thereby improving system availability.

2. The manifold system of claim 1, wherein the manifold assembly is a first manifold assembly and including a second manifold assembly, wherein the first and second manifold assemblies are connect to the outlet via a common shuttle valve, and wherein the first and second manifold assemblies are connected to the fluid inlet by the first isolating valve and a second isolating valve, respectively.

3. The manifold system of claim 2, wherein the first and second inlet isolating valves are Manually Operated Valves.

4. The manifold system of claim 2, wherein each of the manifold assemblies includes a plurality of third shuttle valves, each of said third shuttle valves operatively coupled to either the first shuttle valve or to the redundant shuttle valve to allow the flow of the fluid from each of the first solenoid operated valves to each of the second solenoid operated valves.

5. The manifold system of claim 1, wherein the plurality of first isolating valves are Manually Operated Valves.

6. The manifold system of claim 1, wherein the manifold assembly includes a plurality of pressure sensors, each of the pressure sensors operatively coupled to an associated Solenoid Operated Valve and to an associated indicator, wherein each of said indicators is arranged to indicate the status of its associated Solenoid Operated Valve.

7. The manifold system of claim 1, wherein the system includes at least one second shuttle valve connecting the second solenoid operated valves to the fluid outlet.

8. The manifold system of claim 1, wherein each of the isolating valves is a 3/2 valve.

9. The manifold system of claim 1, including at least one exhaust to vent exhaust residue.

10. The manifold system of claim 1, including a plurality of second isolating valves, each positioned upstream of a respective one of the second Solenoid Operated Valves.

* * * * *